US009737132B2

(12) United States Patent
Bruns et al.

(10) Patent No.: US 9,737,132 B2
(45) Date of Patent: Aug. 22, 2017

(54) MOVEMENT AND SECUREMENT FEATURES FOR A STRUCTURE, PARTICULARLY A WEARABLE ARTICLE

(71) Applicants: Judi Lynn Bruns, Waynesville, NC (US); Daniel James Bruns, Waynesville, NC (US)

(72) Inventors: Judi Lynn Bruns, Waynesville, NC (US); Daniel James Bruns, Waynesville, NC (US)

( * ) Notice: Subject to any disclaimer, the term of this patent is extended or adjusted under 35 U.S.C. 154(b) by 0 days.

(21) Appl. No.: 14/573,298

(22) Filed: Dec. 17, 2014

(65) Prior Publication Data

US 2015/0237997 A1 Aug. 27, 2015

Related U.S. Application Data

(63) Continuation-in-part of application No. 13/676,557, filed on Nov. 14, 2012, now abandoned.

(60) Provisional application No. 62/070,501, filed on Aug. 25, 2014, provisional application No. 61/999,368, filed on Jul. 23, 2014, provisional application No. 61/963,935, filed on Dec. 17, 2013.

(51) Int. Cl.

| | |
|---|---|
| ***A45F 5/02*** | (2006.01) |
| *A45C 3/06* | (2006.01) |
| *A45F 3/04* | (2006.01) |

(52) U.S. Cl.

CPC ..... *A45F 5/021* (2013.01); *A45F 5/02* (2013.01); *A45C 3/06* (2013.01); *A45F 3/04* (2013.01); *A45F 2005/027* (2013.01); *A45F 2005/028* (2013.01); *A45F 2200/0516* (2013.01)

(58) Field of Classification Search

CPC .... A45F 5/021; A45F 5/02; A45F 3/04; A45F 2005/027; A45F 2005/028; A45F 2200/0516; A45C 3/06

USPC ..... 224/195, 200, 660, 271, 930

See application file for complete search history.

(56) References Cited

U.S. PATENT DOCUMENTS

| | | | | |
|---|---|---|---|---|
| 6,082,034 | A * | 7/2000 | Musmanno | 42/94 |
| 6,359,609 | B1 * | 3/2002 | Kuenster et al. | 345/156 |
| 7,110,802 | B1 * | 9/2006 | Kim et al. | 455/575.6 |
| 7,624,955 | B2 * | 12/2009 | McGill | 248/181.1 |
| 8,056,780 | B1 * | 11/2011 | Bruns | 224/163 |
| 8,070,026 | B2 * | 12/2011 | Wadsworth et al. | 224/197 |
| 8,267,294 | B2 * | 9/2012 | Yu et al. | 224/623 |
| 8,505,790 | B2 * | 8/2013 | Yu et al. | 224/185 |
| 8,881,961 | B1 * | 11/2014 | Cibirka | 224/265 |
| 8,998,161 | B2 * | 4/2015 | Larson | 248/441.1 |
| 2005/0092791 | A1 * | 5/2005 | Labarca | A45F 5/02 224/269 |
| 2006/0138301 | A1 * | 6/2006 | Kaufman | 248/682 |

* cited by examiner

*Primary Examiner* — Corey Skurdal
(74) *Attorney, Agent, or Firm* — John L Sotomayor

(57) ABSTRACT

There is provided a device for securing a compact portable device to an external arrangement and the device includes a base attachable to the external arrangement, a panel, an attachment for securing the compact portable device to the panel, and a movement element movably connecting the panel to the base in a manner such that the panel can selectively be oriented in one orientation to support the compact portable device in generally facing relationship to the base generally and in another orientation in which the compact portable device is not in generally facing relationship to the base.

8 Claims, 26 Drawing Sheets

MOVEMENT AND SECUREMENT FEATURES FOR A STRUCTURE, PARTICULARLY A WEARABLE ARTICLE

PRIORITY CLAIM

This Non-Provisional application claims under 35 U.S.C. §120, the benefit of priority as a Continuation-in-Part to the Non-Provisional application Ser. No. 13/676,557, filed Nov. 14, 2012 titled "Article-Secured Portable Device", and to Provisional Application 61/963,935, filed Dec. 17, 2013, and to Provisional Application 61/999,368, filed Jul. 23, 2014 and to Provisional Application 62/070,501, filed Aug. 25, 2014, each of which is hereby incorporated by reference in its entirety.

SUMMARY OF THE INVENTION

According to one aspect of the present invention, there is provided an assembly consisting of a top encasement, a base plate, and a tilt and rotate mechanism in which a compact portable device can be secured and attached to an article. The assembly consists of moving parts which provide the ability of the user to wear, attach (to a belt or strap for example), tilt open the top encasement up to and including 270 degrees (although the typical degree of tilt is about 180 degrees, this may be extended to include 270 degrees), and rotate the top encasement around 360 degrees freely in either direction. The compact portable device may or may not include a viewing screen.

According to another aspect of the present invention, there is provided an apparatus used to hold a compact portable device consisting of one or more clenching clips that allow the user to safely and securely attach the apparatus to a number of items.

According to a further aspect of the present invention, there is provided a unit consisting of a top encasement, a base plate, a rotating mechanism, a tongue extension, and a "clenching" clip attached to the base plate. The unit consists of moving parts which provide the ability of the user to wear, attach (to a belt or strap for example), tilt open the top encasement, rotate the top encasement from side to side in either direction, and rotate the top encasement around 360 degrees freely in either direction.

BRIEF DESCRIPTION OF THE DRAWINGS

FIG. 5 is a three dimensional view of the assembly with the top encasement closed ("closed facing in") with the compact portable device facing in.

DETAILED DESCRIPTION OF AN EMBODIMENT

With reference to further details of the one aspect of the present invention, there is provided an assembly consisting of a top encasement, a base plate, and a tilt and rotate mechanism in which a compact portable device can be secured and attached to an article. The assembly consists of moving parts which provide the ability of the user to wear, attach (to a belt or strap for example), tilt open the top encasement up to and including 270 degrees (although the typical degree of tilt is about 180 degrees, this may be extended to include 270 degrees), and rotate the top encasement around 360 degrees freely in either direction. The compact portable device may or may not include a viewing screen. The compact portable device is representative of any one of a number of devices such as but not limited to examples such as a personal digital assistant (PDA), cellular telephone, smart device, smart phone, tablet, "note" style tablet, portable music/media player, video game device, and satellite radio receiver. The tilt and rotate mechanism is to include but not limited to; being a part of the actual chassis of the compact portable device, a part of the top encasement that surrounds the compact portable device, or part of the base plate of the assembly itself to which the top encasement can be attached. In this illustration, for example, the tilt and rotation is made possible by the design and assembly of the mechanism configured within the baseplate. The top encasement can be closed onto the base plate in a manner such that it can be selectively orientated; allowing the viewing screen to be seen or hidden if applicable. When the encasement is not dosed, it can be selectively oriented with the top encasement extended outwardly to any degree up to 270 degrees and turned and rotated any degree up to and including 360 degrees for viewing the viewing screen of the compact portable device if applicable. The top encasement, which holds the compact portable device, is attachable and detachable to the base plate via a tongue extension of the base plate for example, which attaches to the back of the encasement.

In one aspect the user can attach the assembly to a purse for example, and keep the top encasement closed facing out or dosed facing in. In another aspect, the user can attach the assembly to a belt for example, tilt the top encasement out any degree decided between zero and 270, and in addition, rotate the top encasement from zero to 360 degrees and either direction they decide in order to view the compact portable device, which is secured inside of the top encasement. The user therefore, is given the freedom to lie down, stand, walk, hike, bike, etc. and still have immediate, hands free access to the compact portable device without having to remove it from the assembly. The users have numerous varying degrees of tilt and rotate of said apparatus simultaneously.

Figure 1:
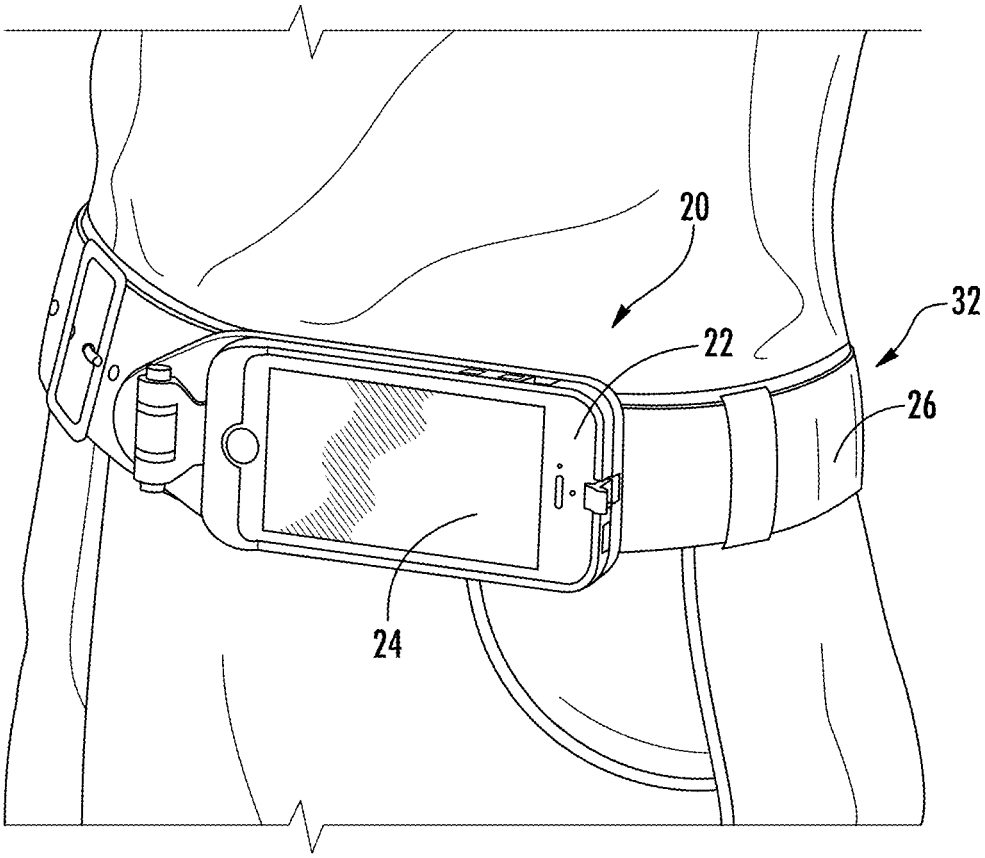
FIG. 1 illustrates the assembly of the one aspect of the present invention attached to an article in the representative form of a belt.
Figure 2:
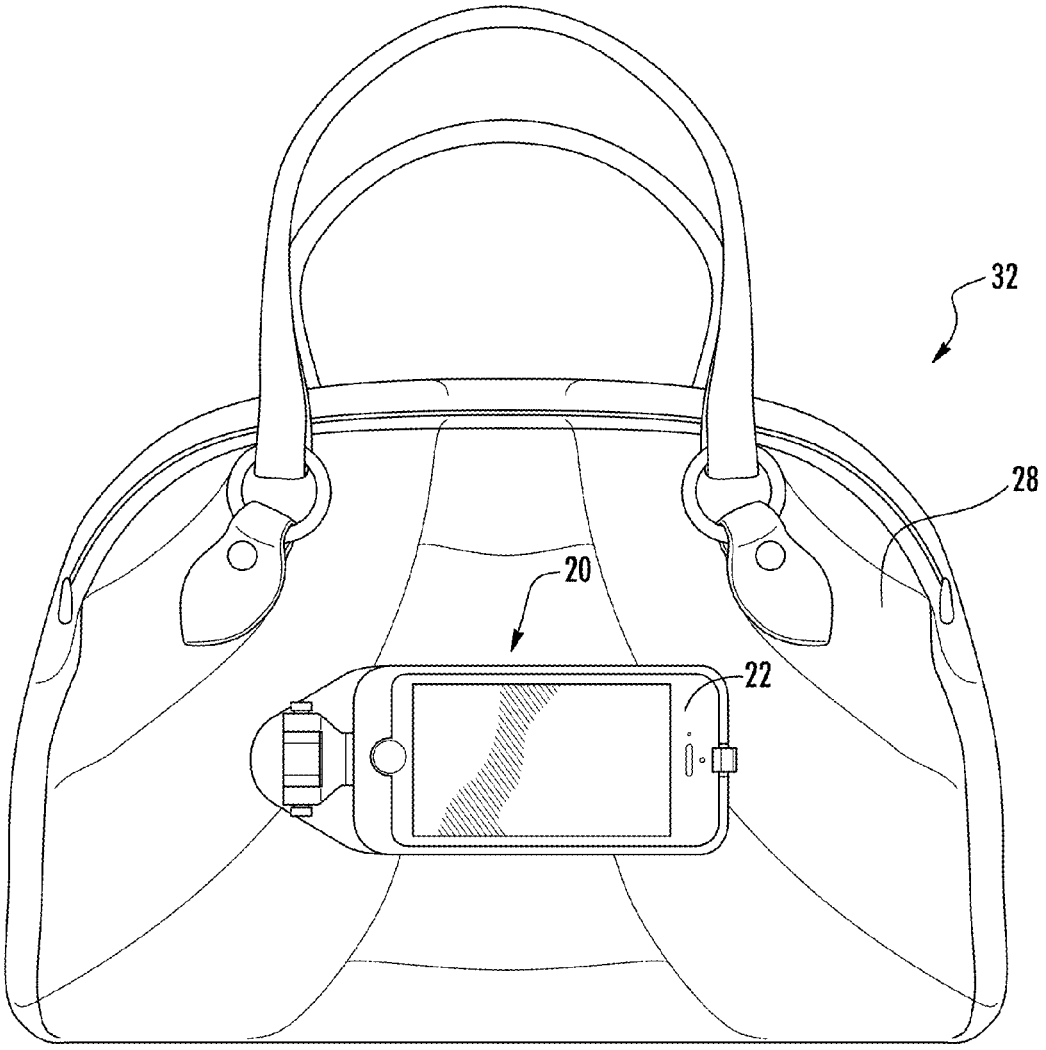
FIG. 2 illustrates the assembly embodying the invention attached to an article in the representative form of a purse.

Referring to FIG. 1, the assembly embodying the invention and generally designated 20 is shown securing a compact portable device 22 in the representative form of a "smartphone", such as an iPhone®, including a viewing screen 24, to an article 32 in the representative form of a belt 26 for example, carried by or worn by a person. The compact portable device 22 is representative of any number of suitable devices. Alternatively, in FIG. 2, the assembly 20, with an attached compact portable device 22, is attached to an article 32 is in the representative form of a purse 28. The means of attachment in this example may be in the form of rivets. This is only one example of several methods of attachment such as clips, pins, and screws.

Figure 3:
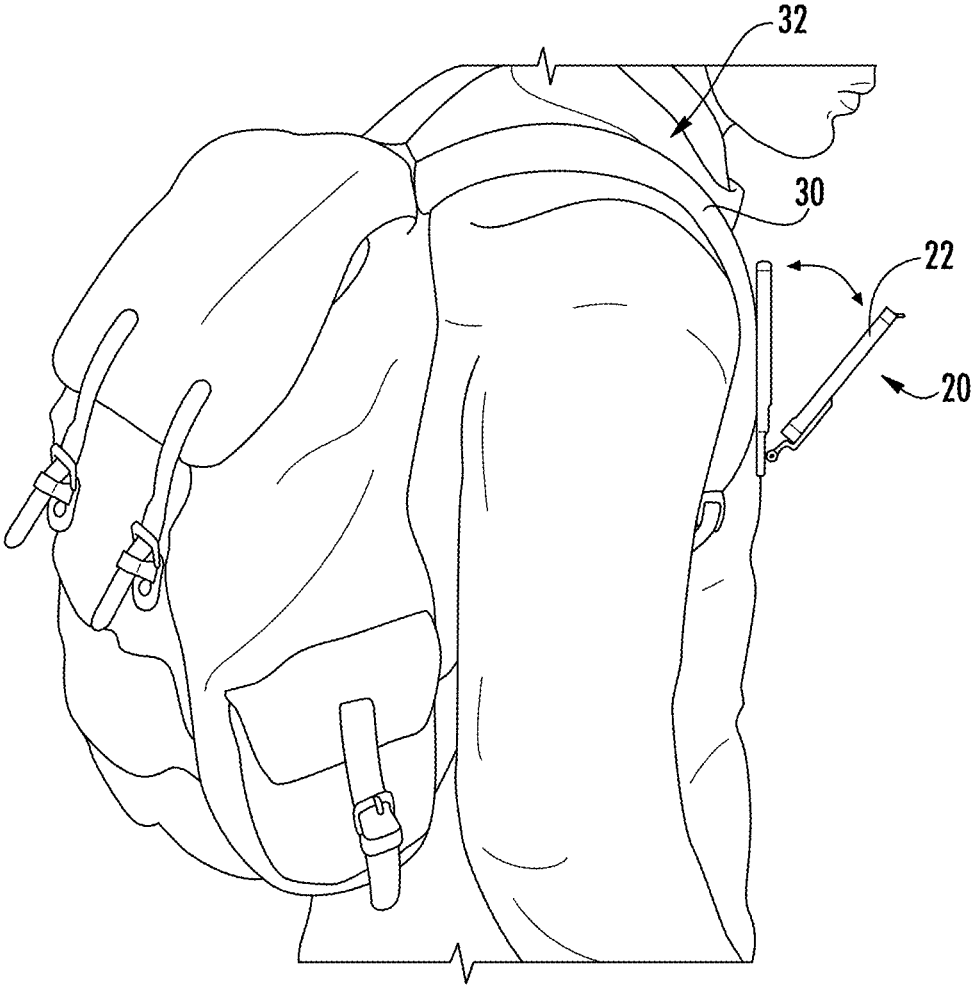
FIG. 3 similarly illustrates the assembly embodying the invention attached to an article in the representative form of a backpack.

As seen in FIG. 3, the assembly 20, with an attached compact portable device 22, is attached to an article 32 is in the representative form of a strap on a backpack 30. The means of attachment in this example may be in the form of a clip. This is only one example of several methods of attachment such as rivets, pins, and screws.

Figure 4:
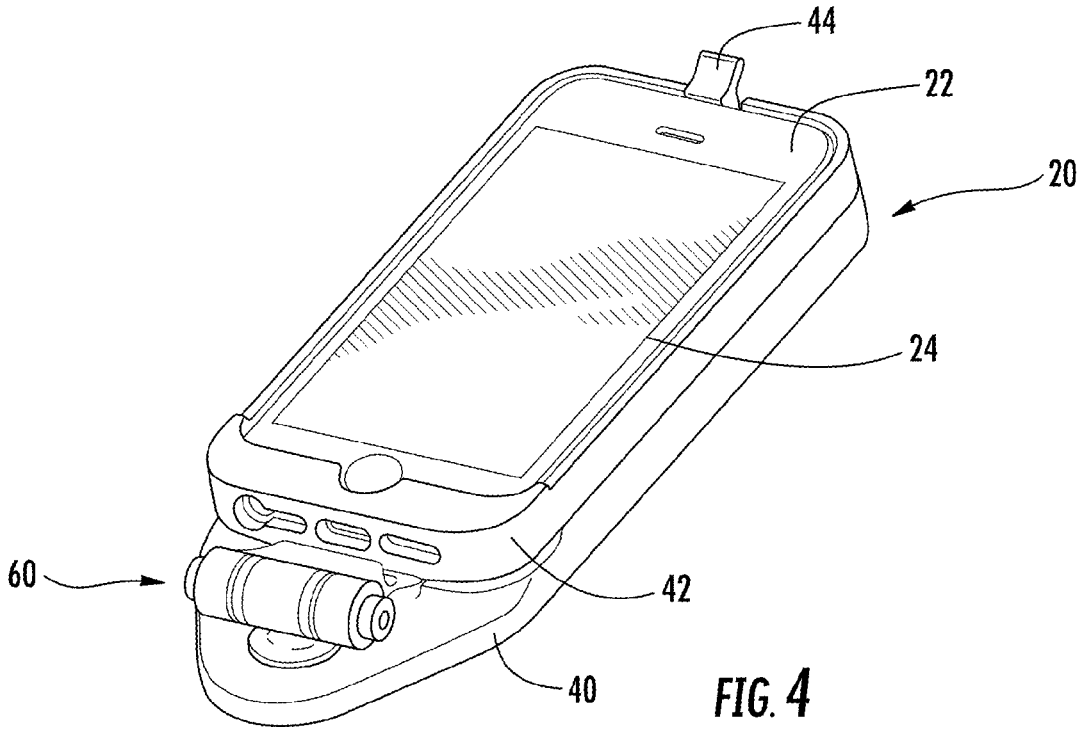
FIG. 4 is a three dimensional view of the assembly with the top encasement closed ("closed facing out") with the compact portable device facing outward.

As noted above, the belt 26, the purse 28, and the strap of a backpack 30 are representative forms of an article 32. It will be appreciated that the assembly 20 may be used to secure a compact portable device 22 to other articles 32 (not shown) carried or worn by a person. Other examples are a waistband, a backpack itself, or a stand. FIG. 4 illustrates the assembly 20 in the "closed facing up" orientation; meaning the compact portable device 22 viewing screen 24 is visible when closed. The assembly 20 more particularly includes a base plate 40, a top encasement 42 (which holds a compact portable device 22), a closure clip 44, and a tilt and rotate mechanism 60.

Figure 5:
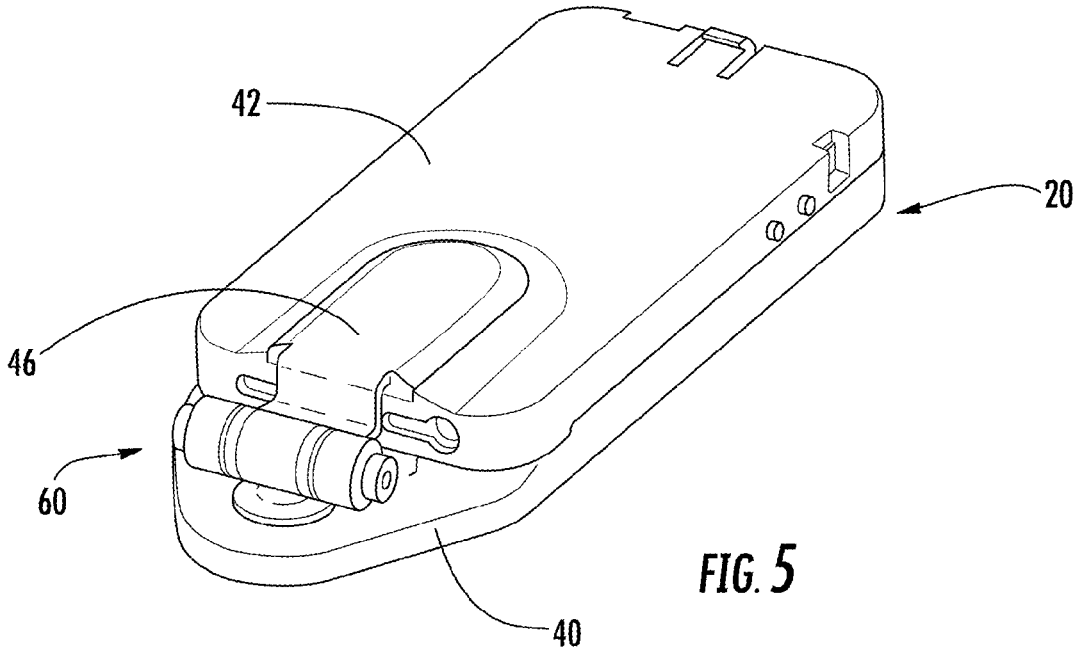

FIG. 5 is similar to FIG. 4 but illustrates the assembly 20 in the "closed facing down" orientation; meaning the compact portable device 22 and viewing screen 24 is not visible when closed. This orientation illustrates the tongue extension 46 when attached to the top encasement 42, as well as the tilt and rotates mechanism 60, which is part of the base plate 40.

Figure 6:
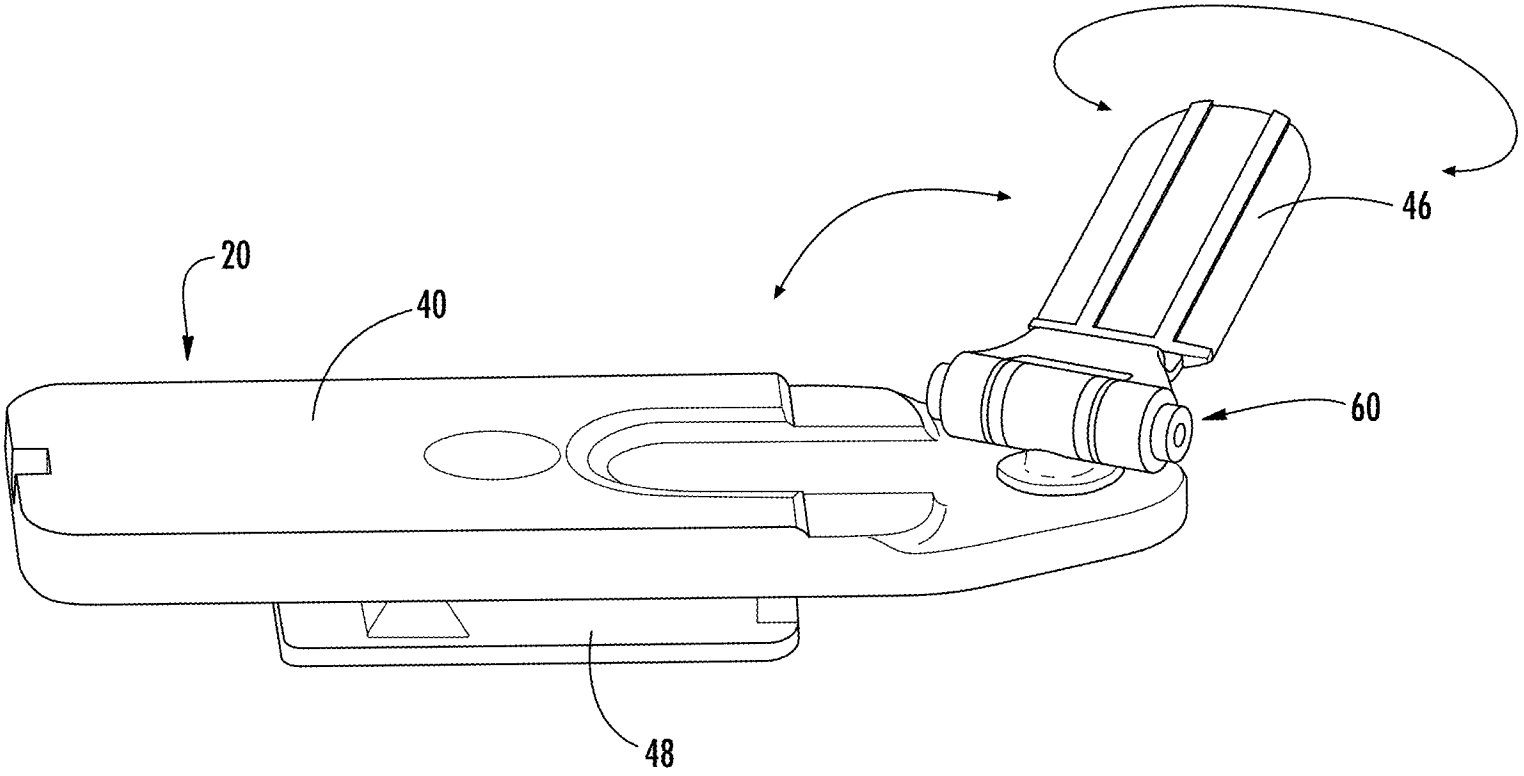
FIG. 6 is a three dimensional view of the assembly with the top portion tilted outwardly and turned but with neither the top encasement nor the compact portable device attached.

FIG. 6 illustrates the assembly 20 with its base plate 40 fully exposed as the tilt and rotate mechanism 60 has been tilted outwardly between 90 and 180 degrees and rotated between 0 and 90 degrees from center. The top encasement 42 has been removed from the tongue extension 46. Underneath the base plate 40, an article attaching clip 48 for example, as a means of attaching to an article 32. The article-attaching clip 48 is merely an example of one of many ways to attach the assembly 20 to an article 32.

Figure 7:
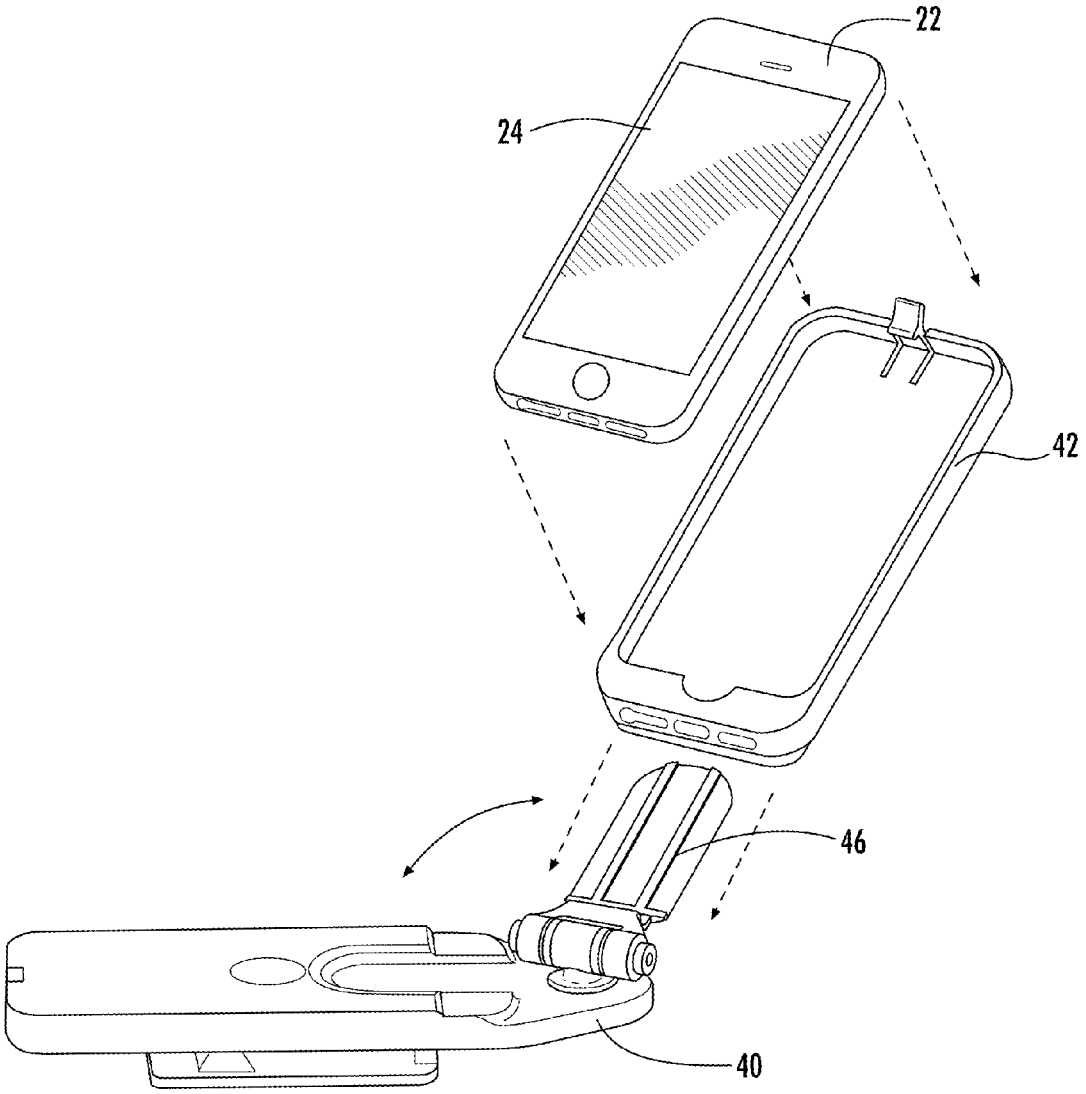
FIG. 7 is a three dimensional view of the assembly with the top portion tilted outwardly and turned demonstrating the manner in which the top encasement will receive the compact portable devices, as well as demonstrate the manner in which the base plate tongue extension will receive the top encasement.

FIG. 7 illustrates the manner in which a compact portable device 22 with viewing screen 24 sets into the top encasement 42 as well as how the top encasement 42 attaches to the tongue extension 46 which is part of the base plate 40.

Figure 8:
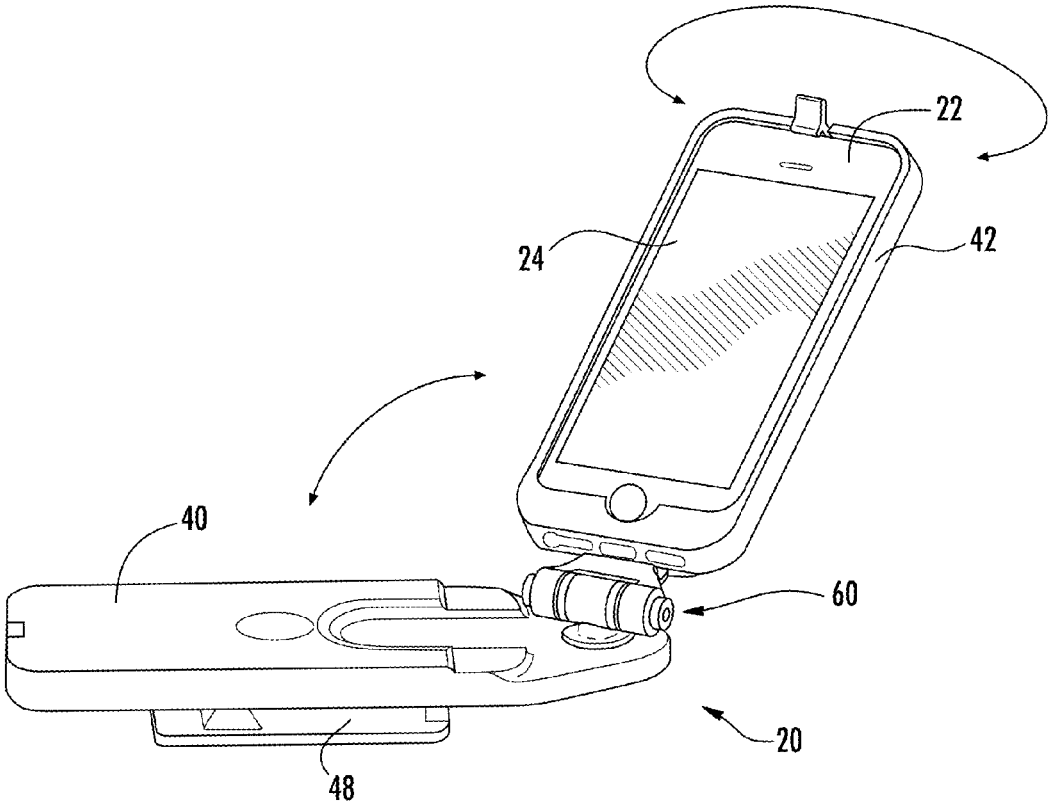
FIG. 8 is a three dimensional view of the assembly with the top encasement and a compact portable device attached and tilted outwardly and rotated.

FIG. 8 illustrates all of the pieces of FIG. 7 together to show the assembly 20 in one of many varying degree "open" positions. The base plate 40 is seen with the article-attaching clip 48 on the bottom of it. The tilt and rotate mechanism 60 has been tilted outwardly between 90 and 180 degrees and rotated between 0 and 90 degrees from center. The top encasement 42 is seen here with an attached compact portable device 22 with a viewing screen 24.

Figure 9:
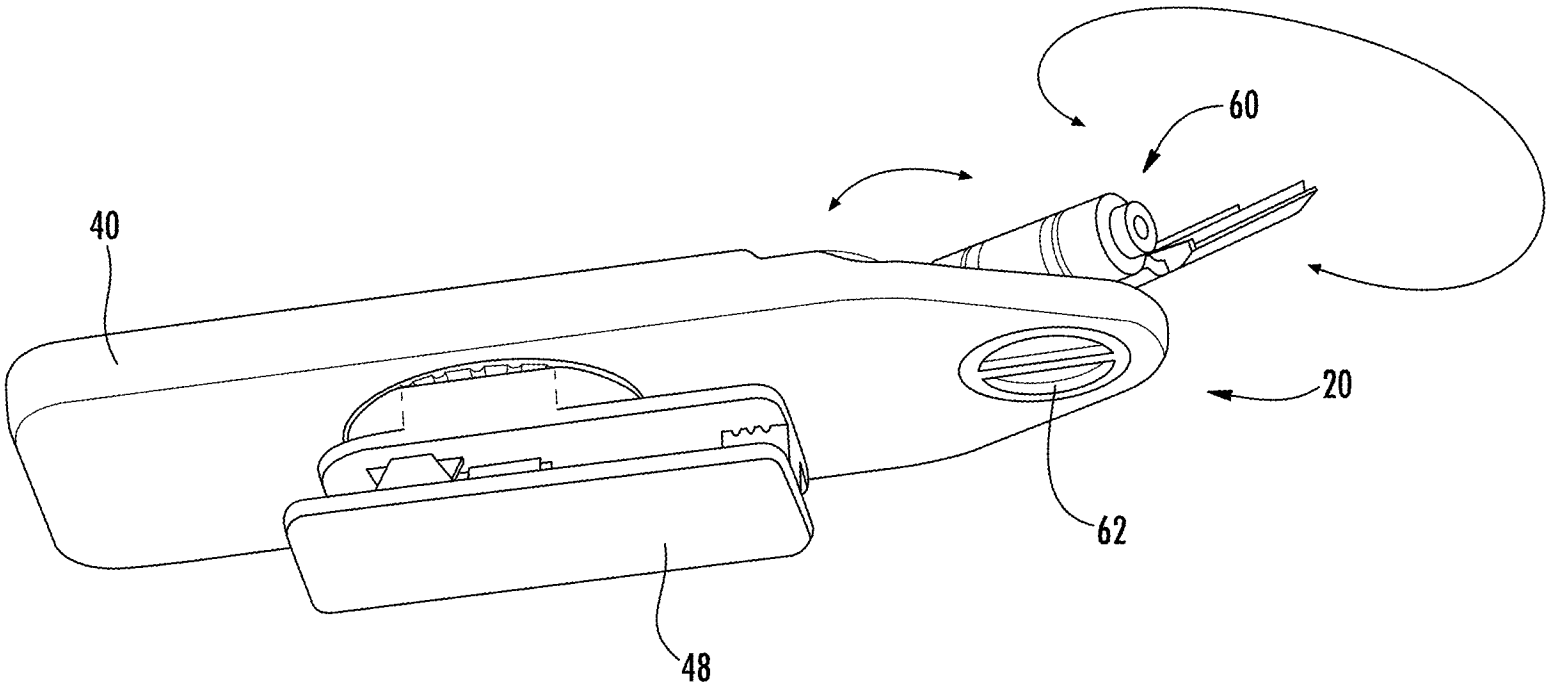
FIG. 9 is similar to FIG. 6 but rotated upward to show the back (bottom) of the base plate.

FIG. 9 illustrates a larger view of the bottom of the base plate 40 of the assembly 20. The article-attaching clip 48 is seen as well as the tension cap 62, which is part of the tilt and rotate mechanism 60.

Figure 10:
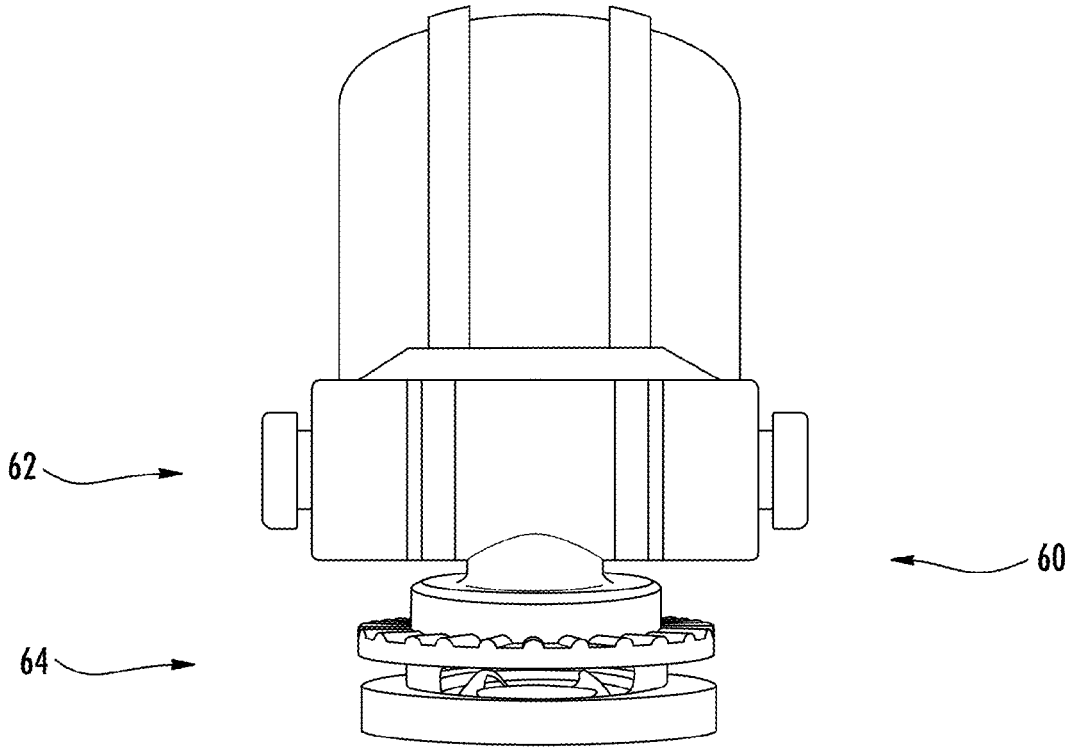
FIG. 10 is an isolated three-dimensional view of the tilt and rotate mechanism which is part of the base plate.

FIG. 10 is an isolated three-dimensional view of the tilt and rotate mechanism 60 which is part of the base plate 40 of the assembly 20. The tilt and rotate mechanism 60 is now broken down into two parts: the tilt assembly 62 and the rotate assembly 64.

Figure 11:
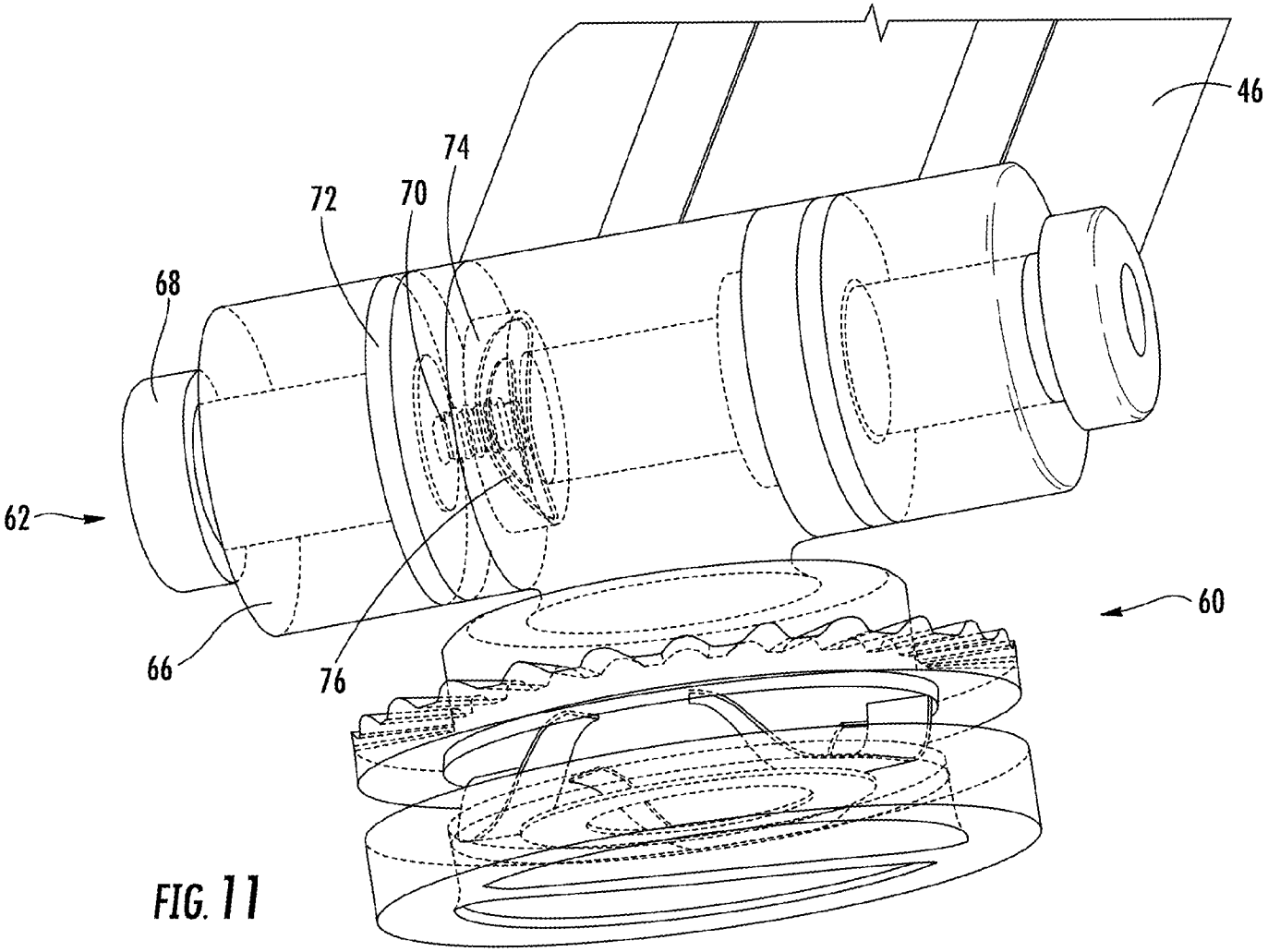
FIG. 11 is an enlarged view of the tilt and rotate mechanism with increased visualization of the tilt assembly.

FIG. 11 is an enlarged three-dimensional view of the tilt and rotate mechanism 60 with special focus being placed upon the tilt assembly 62. The tilt assembly 62 is part of the base plate 40 of the assembly 20 as well as the tongue extension 46. Within the hinge leaf 66, there is a hinge pin button assembly 68 containing a screw 70 in the center of it. A rubber washer 72 is placed between the hinge pin base 74 and the hinge leaf 66. The screw 70 applies tension to the tension washer 76 which will then applies tension to the tilt assembly 62 in general. This design s duplicated on both sides.

Figure 12:
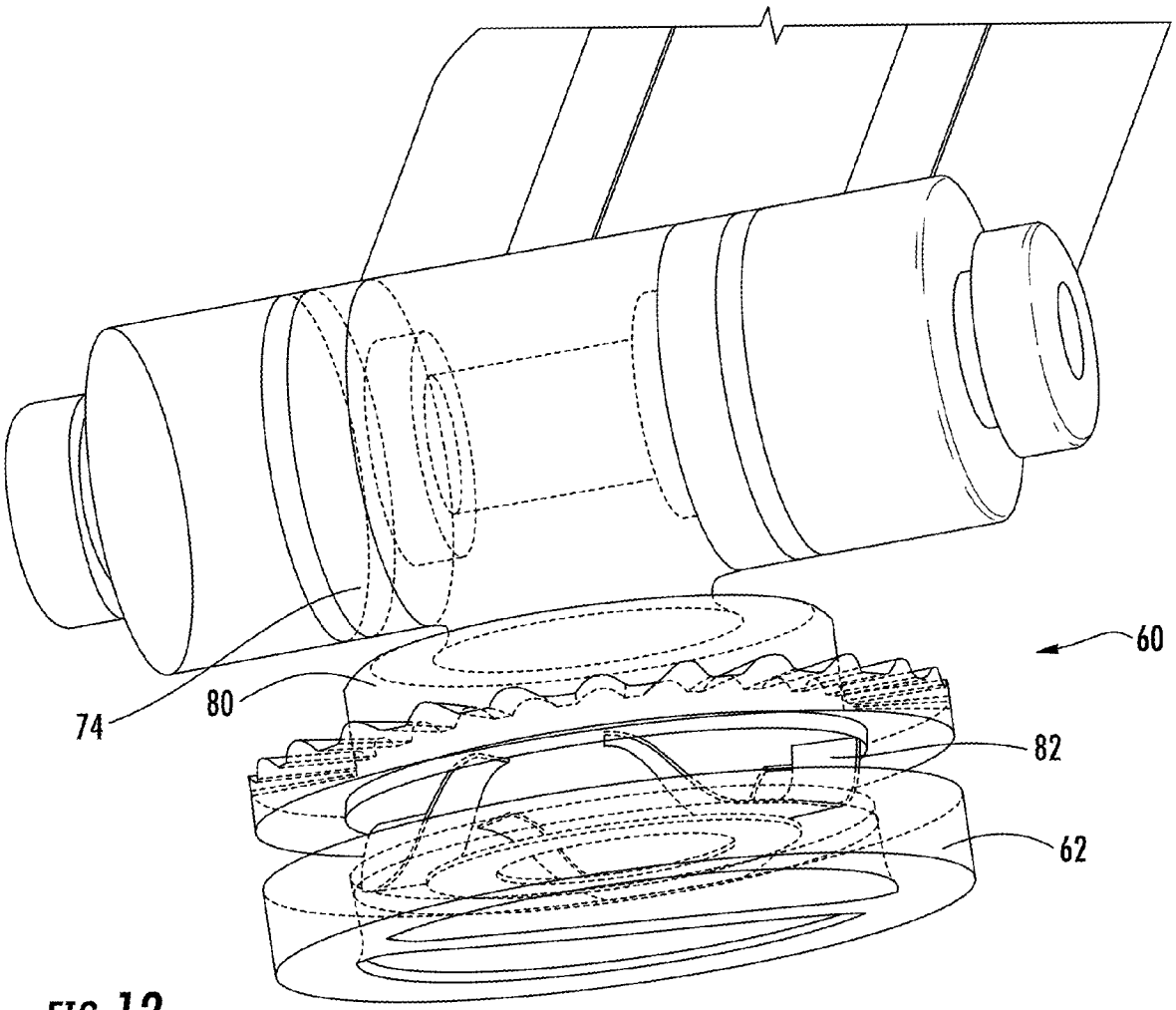
FIG. 12 is an enlarged view of the tilt and rotate mechanism with increased visualization of the rotate assembly.

FIG. 12 is an enlarged three-dimensional view of the tilt and rotate mechanism 60 with special focus being placed upon the rotate assembly 64. The hinge knuckle mechanism 80, which is connected to the hinge pin base 74, is able to rotate 0 to 360 degrees via the tension leaf spring 82 controlled by the amount of pressure put on it by the tension cap 62.

In summary, the tilt and rotate mechanism 60 including the tongue extension 46, provides a connection between the moveable top encasement 42 and the base plate 40, and in addition is detachable. Significantly, the tilt and rotate mechanism 60 and the tongue extension 46 allow the top encasement 42 containing a compact portable device 22 to be selectively oriented with reference to the base plate 40 in various positions and orientations. The tilt assembly 62 allows zero to 270 degrees of tilt outward from the base plate 40. The rotate assembly 64 allows zero to 360 degrees of rotation simultaneously during varying degrees of tilt.

With reference to further details of the another aspect of the present invention, there is provided an apparatus used to hold a compact portable device consisting of one or more clenching clips that allow the user to safely and securely attach the apparatus to a number of items. The compact portable device in which the apparatus will serve is representative of any one of a number of devices such as but not limited to examples such as a personal digital assistant (PDA), cellular telephone, smart device, smart phone, tablet, "note" style tablet, portable music/media player, video game device, and satellite radio receiver.

One feature of this apparatus is the attaching clips. The clips can be used independently or dependently. The clips are what secures the apparatus to varying objects such as but not limited to a strap or belt for example. The apparatus does not necessarily have to be clenched down into a notch in order for it to be effective. It can remain in the open "un-notched" position and be clipped onto a belt for example. Often however, straps are vertical and the ability to keep the apparatus from sliding down requires a firm steady attachment and therefore the need for the clenching dips. Due to the manner of differing thicknesses of many items the apparatus is being attached to, the clips themselves can vary in the amount of "clenching" each clip is given. The degree of "clenching" can be easily changed by pushing the clip portion with its dipping pin down into the notches on the apparatus itself, or lifting the clip with its dipping pin up out and off of the notches to unclench it. The clipping pin, when snugly put into one of the notches, allow the clip to safely hold its position. There are varying degrees of clenching strength and/or depth depending on the notch used when using the clenching clips. The first notch, the notch closest to the clip when it is in the "un-notched" open position, allows for a thicker item that the apparatus can be attached to, the second notch—a little thinner item, the third notch—an even thinner item, and so on. The individual clips can be clenched into different notches at the same time, meaning: one clip (Clip A for example) can be clenched into the first notch (Number 1 for example) attaching to a thick item, and the other clip (Clip B for example) can be attached to a thin item and clenched into a deeper notch (Notch 3 for example). The ability to securely attach the apparatus to items of varying thickness allows the user to let go with confidence that the apparatus will not slide off of the item such as a strap or belt for example.

Figure 13:
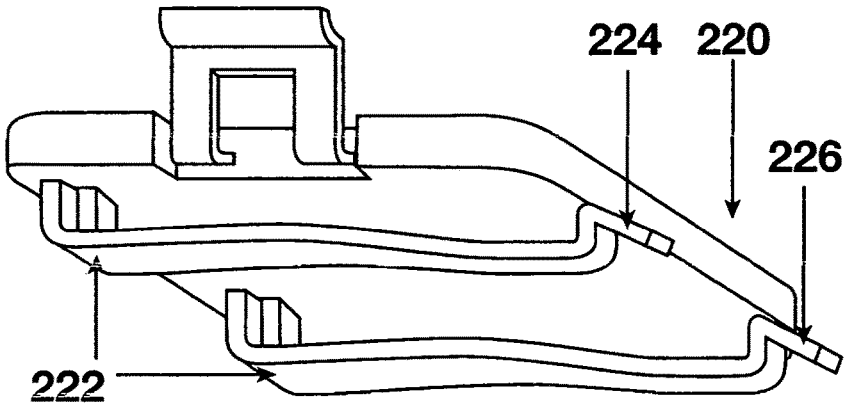
FIG. 13 illustrates the apparatus of the another aspect of the present invention with both clips open, or "un-notched".

Referring to FIG. 13, the apparatus embodying the invention and generally designated 220 includes a pair of clips 222 comprised of a Clip A 224 and a Clip B 226 both shown in the open un-notched position.

Figure 14:
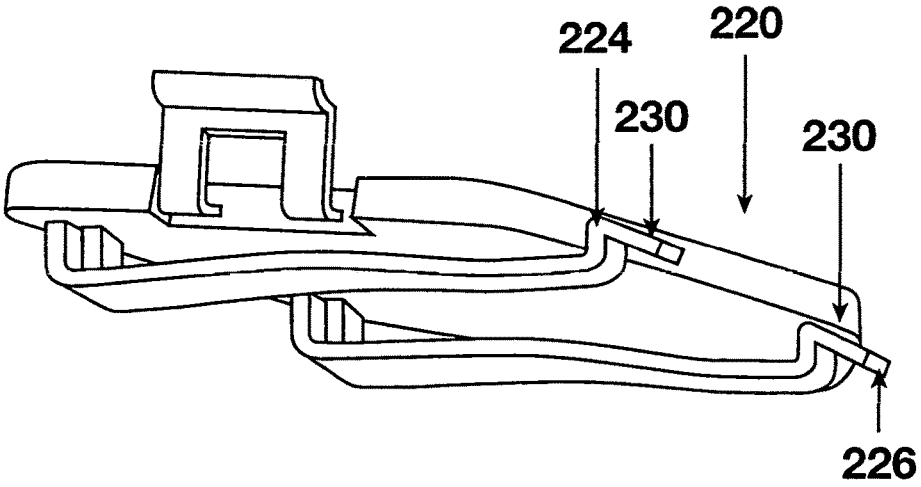
FIG. 14 illustrates the apparatus embodying the invention with 1 clip open and un-notched, and the other clip clenched into a notch.

As seen in FIG. 14 the apparatus 220 is shown with Clip A 224 clenched into a plurality of notches 230 and Clip B 226 in the open un-notched position.

Figure 15:
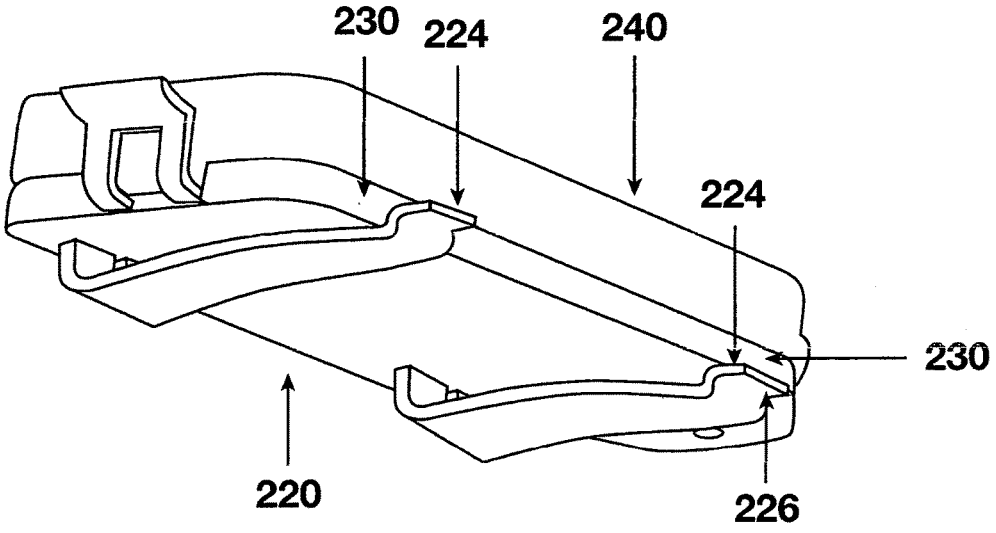
FIG. 15 is similar to FIG. 14 but shown with a compact portable device attached to the apparatus.

As seen in FIG. 15, which is similar to FIG. 14 but shows the apparatus with a compact portable device 240 in the representative form of a "smartphone", such as an iPhone®, attached to the apparatus 320. As shown in FIG. 14, Clip A 224 is clenched into the notches 230 and Clip B 226 is in the open un-notched position.

Figure 16:
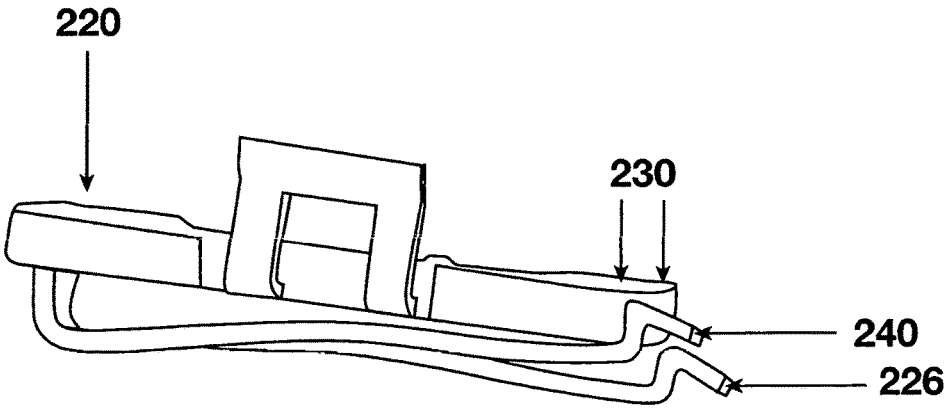
FIG. 16 illustrates and end view of the apparatus embodying the invention with one clip clenched in a notch and the other clip un-notched.

FIG. 16 illustrates the end view of the apparatus 220 embodying the invention with Clip A 224 clenched into the notches 230 and Clip B 226 in the open un-notched position.

Figure 17:
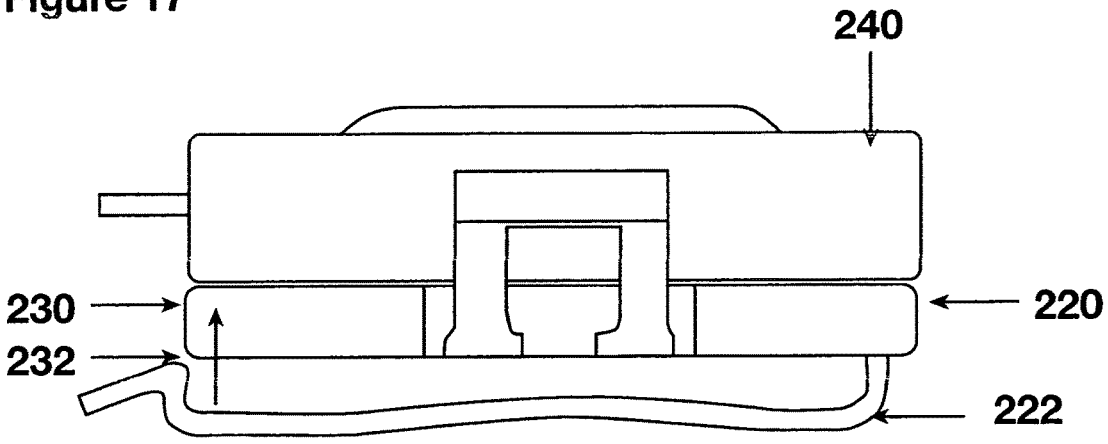
FIG. 17 similar to FIG. 16 but shown with a compact portable device attached to the apparatus. Both clips are open and un-notched showing the detail of the clipping pin.

FIG. 17 is a three dimensional end view of the apparatus 220 with an attached compact portable device 340. This view shows a dipping pin 232 on the clips 222 that secures into the notches 230.

Figure 18:
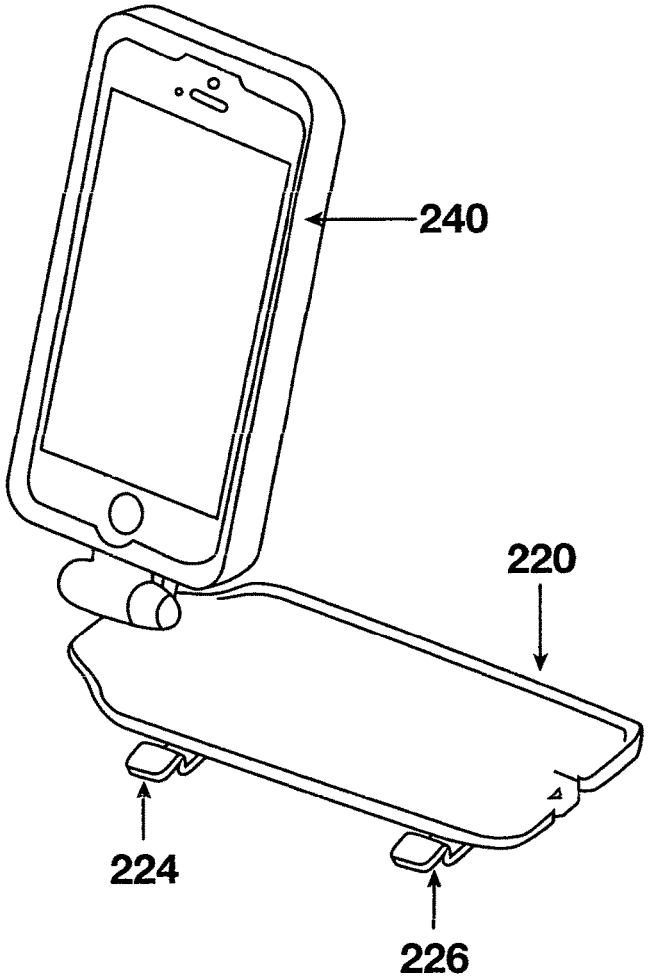
FIG. 18 is a three dimensional view of the apparatus with an attached compact portable device and both clips in the open un-notched position.

FIG. 18 is a three dimensional view of the apparatus 220 with an attached compact portable device 240. Both Clip A 224 and Clip B 226 are shown in the open un-notched position.

Figure 19:
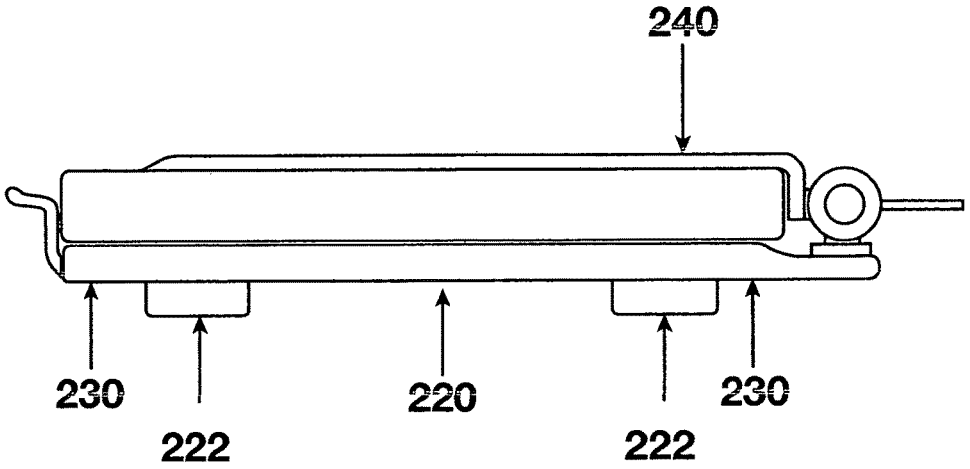
FIG. 19 is a three dimensional view of the apparatus with an attached compact portable device. This illustration shows that the notches for closing the clips are on both sides of the apparatus so the clips can be orientated on either side of the apparatus.

FIG. 19 is a three dimensional view of the apparatus 220 with an attached compact portable device 240. This is the "back side" of the apparatus 220 showing the other set of notches 230 that are available if the clips 222 were put on the opposite side of the apparatus 220.

Figure 20:
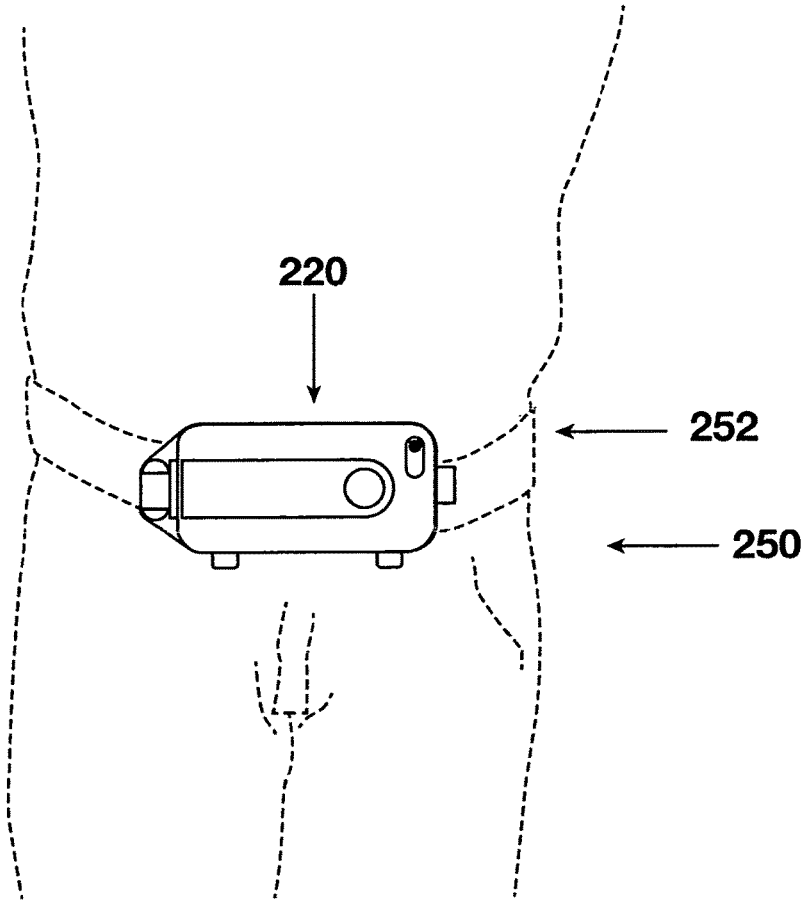
FIG. 20 illustrates the apparatus attached to an item in the representative form of a belt.

FIG. 20 shows the apparatus 220 attached to an item 250 in the representative form of a belt 252.

Figure 21:
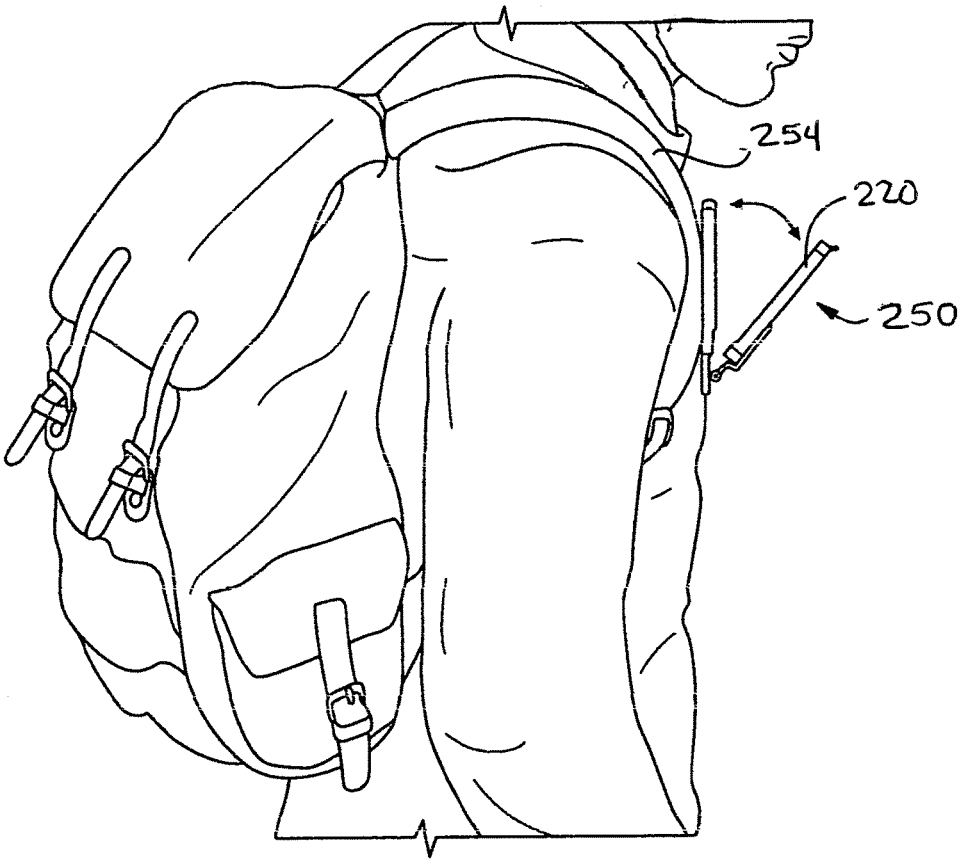
FIG. 21 illustrates the apparatus attached to an item in the representative form of a backpack strap.
Figure 22:
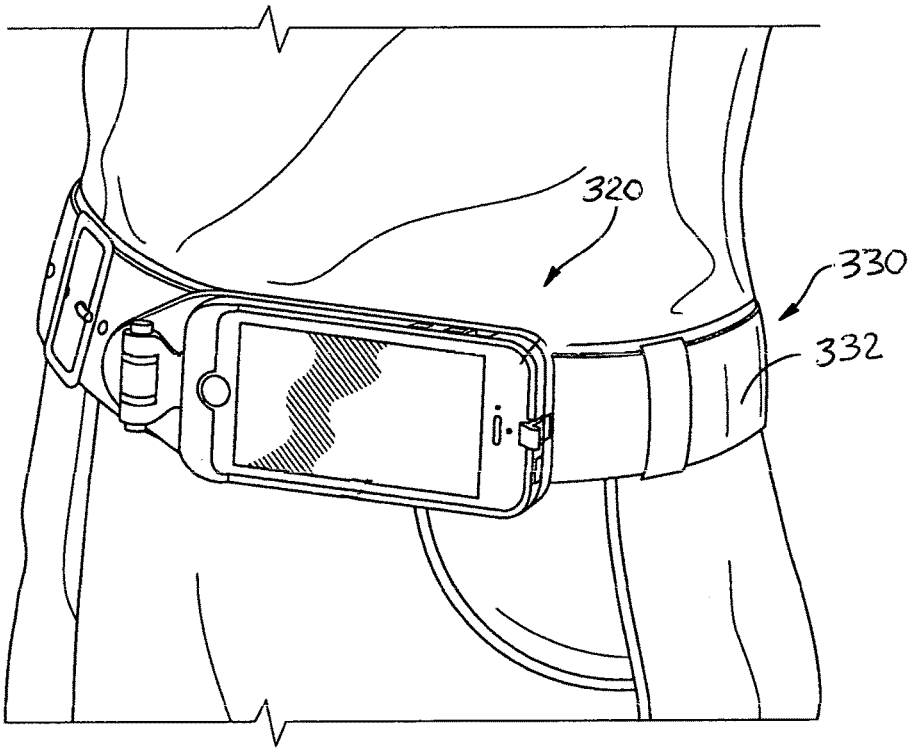
FIG. 22 illustrates the unit of the further aspect of the present invention attached to an article in the representative form of a belt.
Figure 23:
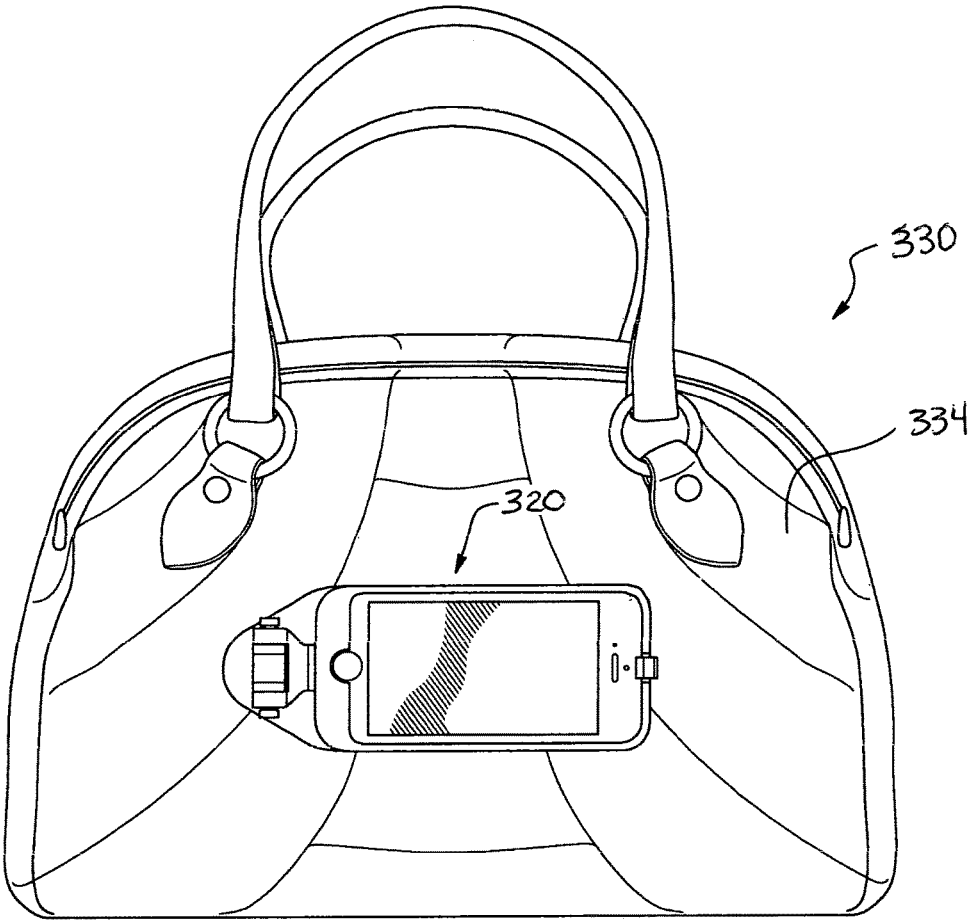
FIG. 23 illustrates the unit embodying the invention attached to an article in the representative form of a purse.
Figure 24:
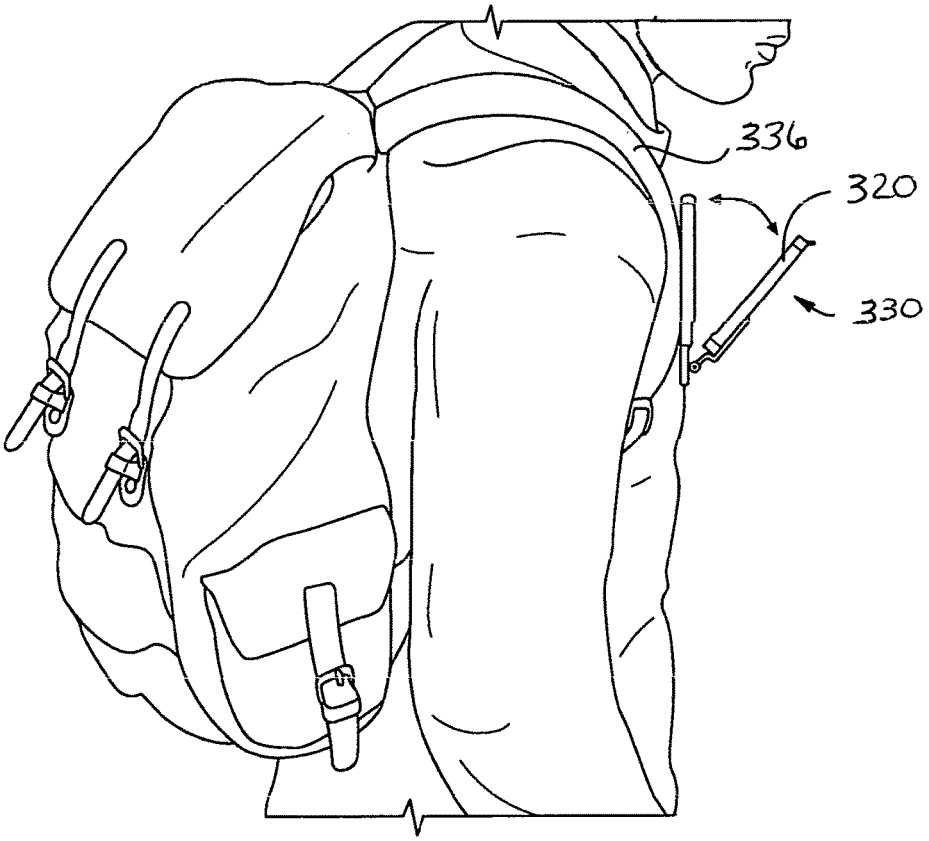
FIG. 24 similarly illustrates the unit embodying the invention attached to an article in the representative form of a backpack.
Figure 25:
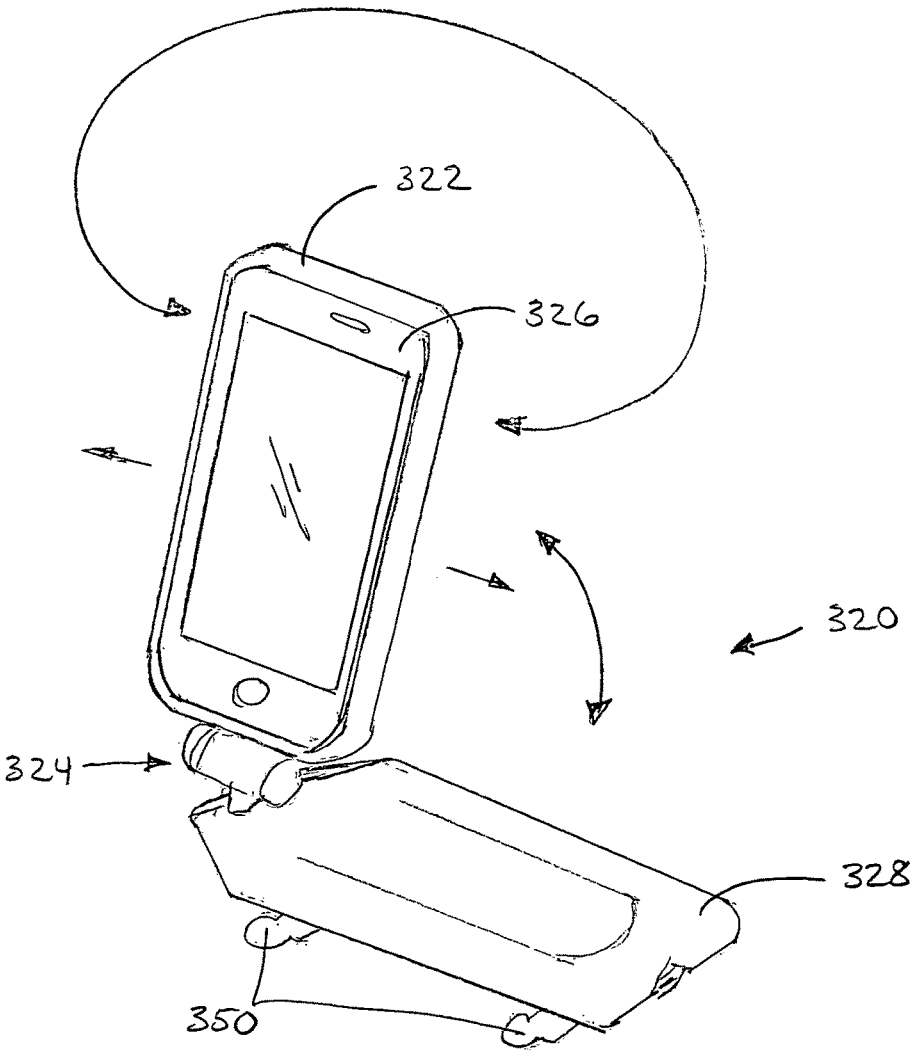
FIG. 25 is a three dimensional view of the unit with the top encasement with a compact portable device, tilted outward and rotated.
Figure 26:
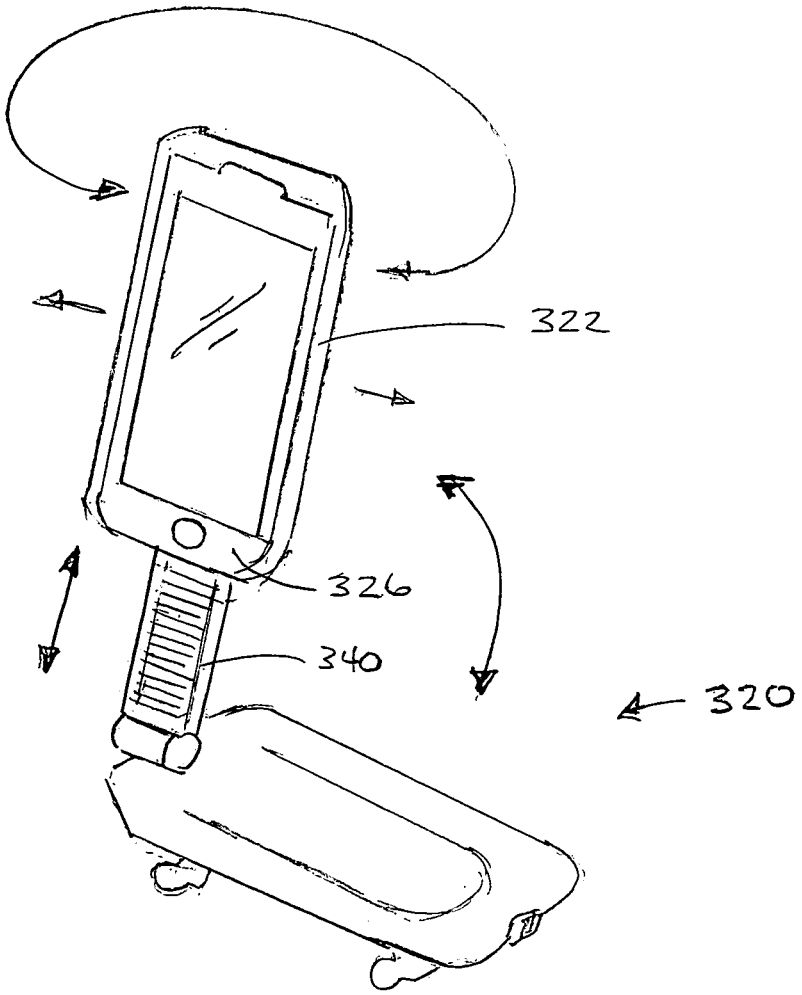
FIG. 26 similar to FIG. 25 but with the top encasement extended, with a compact portable device, outward on the tongue slightly.
Figure 27:
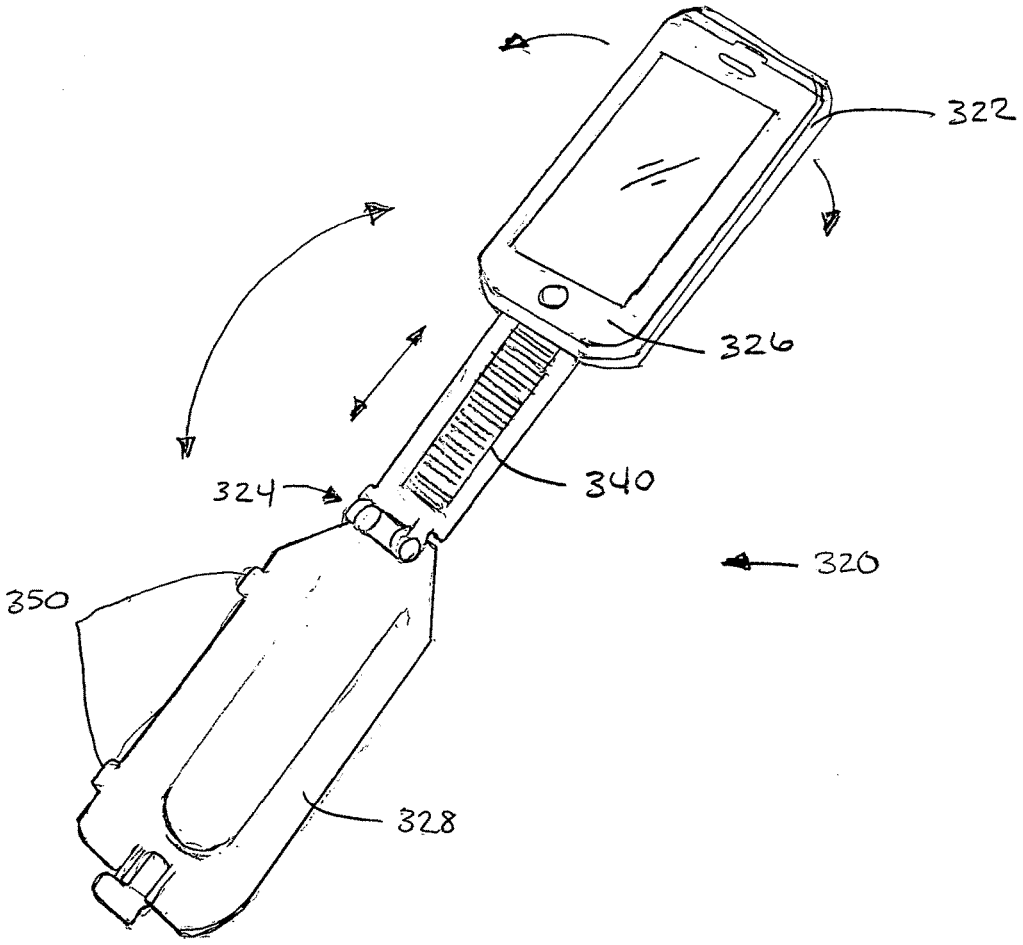
FIG. 27 is a three dimensional view of the unit with the top encasement, with a compact portable, device roughly 180 degrees and extended out on the tongue extension.
Figure 28:
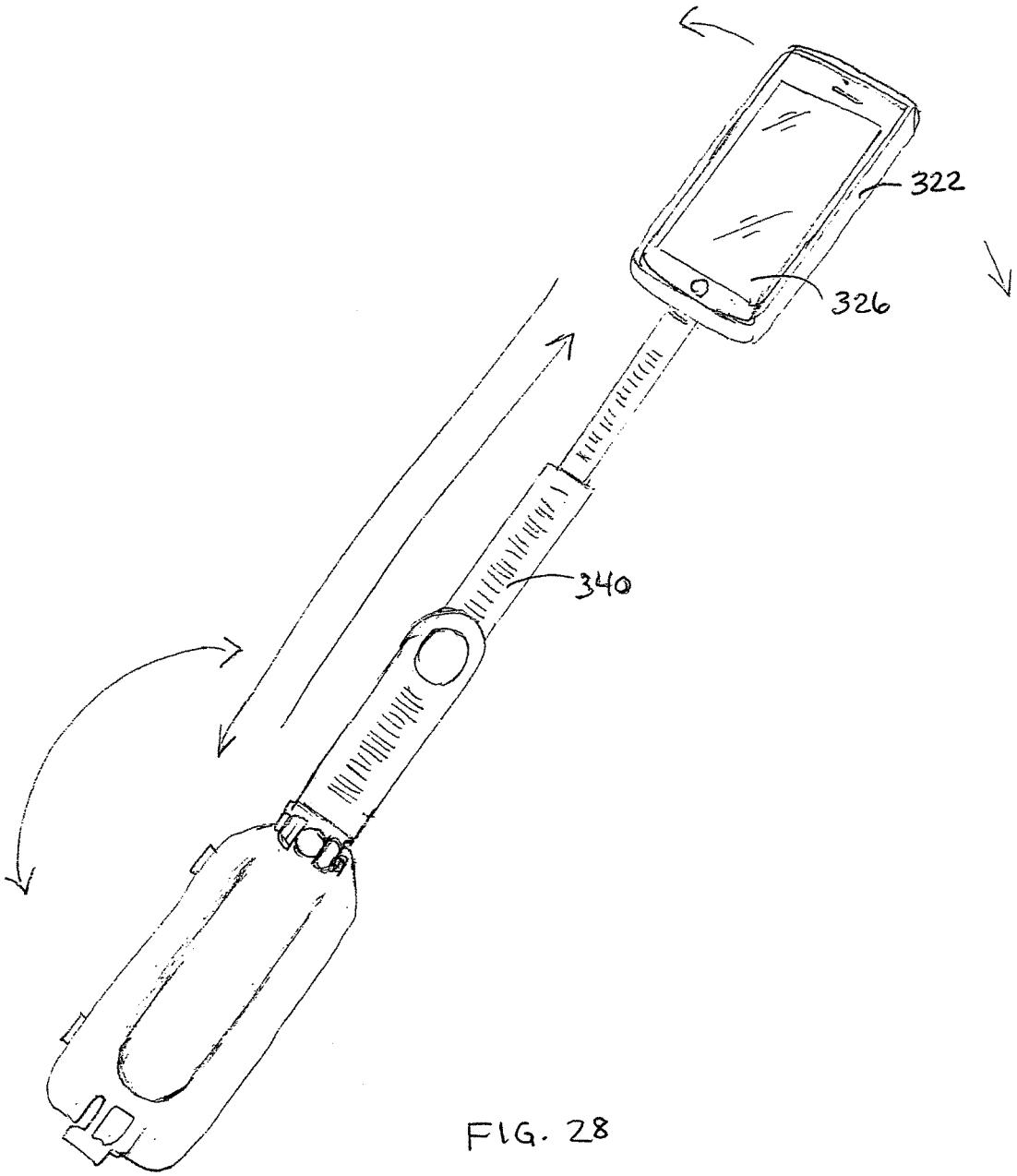
FIG. 28 is similar to FIG. 27 but with the top encasement, with a compact portable device, extended significantly on the tongue extension.
Figure 29:
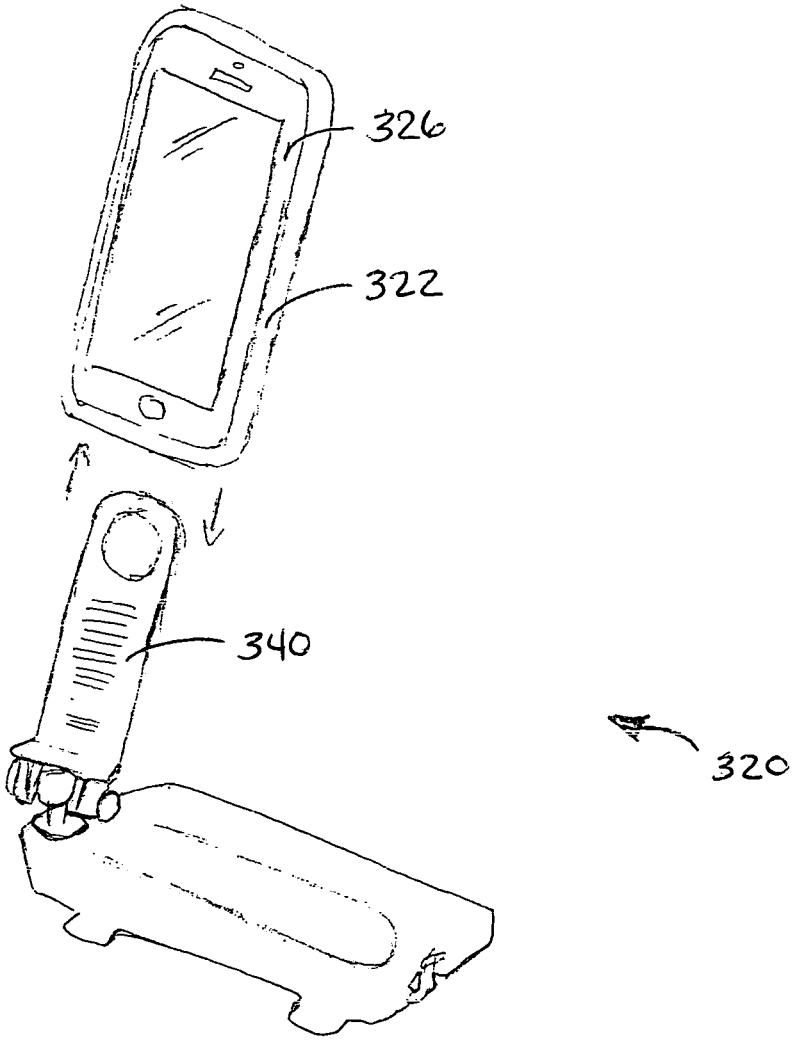
FIG. 29 is a three dimensional view of the unit showing the ability of the top encasement, with (or without) a compact portable device, to be detached an re-attached to the tongue extension.
Figure 30:
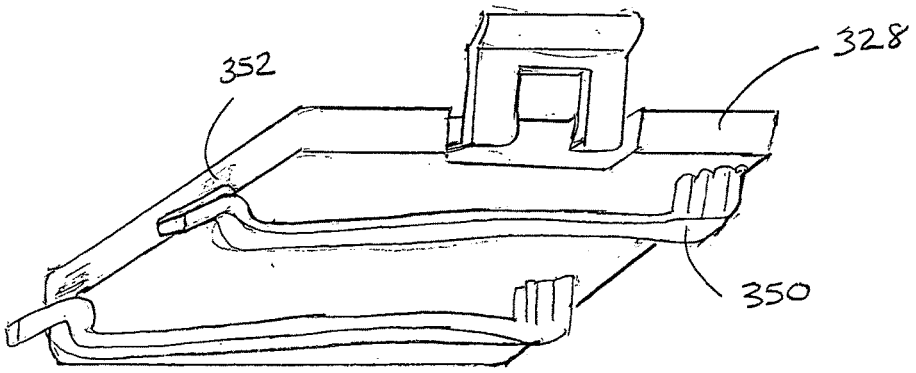
FIG. 30 illustrates a side view of the base plate of the unit alone showing the ability of the clenching clips to be adjusted.
Figure 31:
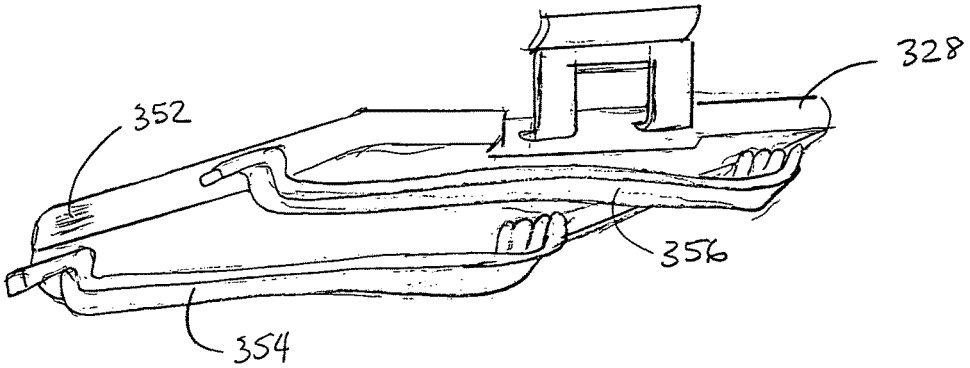
FIG. 31 is a three dimensional view of the base plate alone showing one clenching clip unclenched and the other clenched in several notches.
Figure 32:
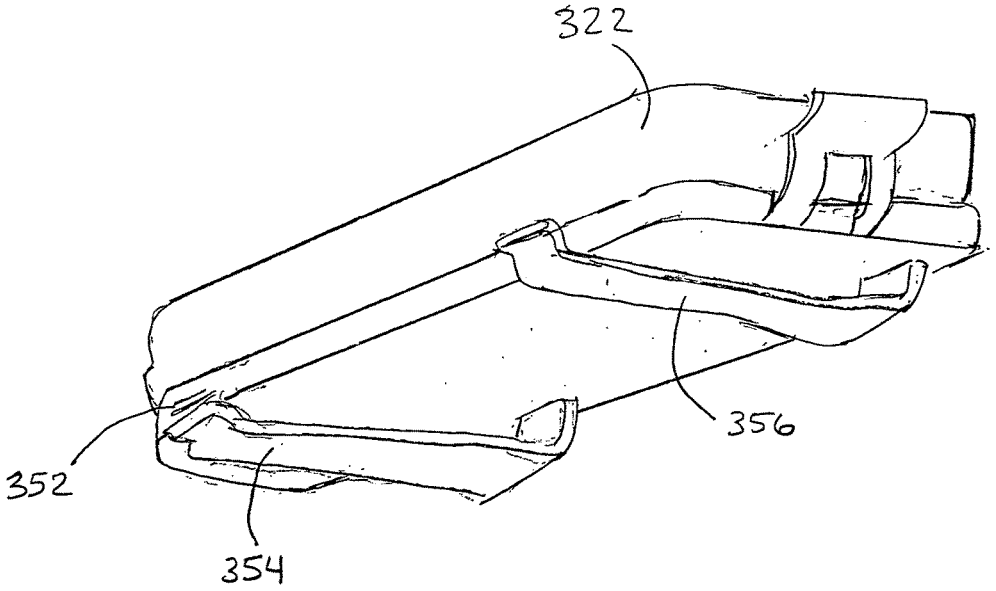
FIG. 32 is similar to FIG. 31 but with the top encasement attached, closed, containing a portable device, and shown with one clenching clip unclenched and the other clenched in several notches.

FIG. 21 shows the apparatus 220 attached to the item 250 which is in the representative form of a backpack strap 254.

In summary, the apparatus 220 including the clips 222, provides a means of attachment to an article 250 of varying thickness. The independent or dependent use of the clips 222 allow the user to safely secure the apparatus 220, with or without a compact portable device 240, to an item of varying thickness. The clipping pin 232 can be clenched into the notches 230 at varying depths depending on the thickness of the item 250 it is being attached to. The apparatus 220 is easily attached and detached from the article 250 by pulling the clips 222 and therefore the extension pin 232 out of the notches 230.

With reference to further details of the further aspect of the present invention, there is provided a unit consisting of a top encasement, a base plate, a rotating mechanism, a tongue extension, and a "clenching" clip attached to the base plate. The unit consists of moving parts which provide the ability of the user to wear, attach (to a belt or strap for example), tilt open the top encasement up to and including 270 degrees (although the typical degree of tilt is about 180 degrees, this may be extended to include 270 degrees), rotate the top encasement from side to side up to and including 90 degrees (although typical degrees of rotation may be about 45 degrees) in either direction, and rotate the top encasement around 360 degrees freely in either direction. Any number of angles and used independently or simultaneously in the X, Y, and/or Z axes. The compact portable device may or may not include a viewing screen. The compact portable device is representative of any one of a number of devices such as but not limited to examples such as a personal digital assistant (PDA), cellular telephone, smart device, smart phone, tablet, "note" style tablet, portable music/media player, video game device, and satellite radio receiver. The rotating mechanism is to include but not limited to; being a part of the actual chassis of the compact portable device, a part of the top encasement that surrounds the compact portable device, or part of the base plate of the unit itself to which the top encasement can be attached. In this illustration, for example, the rotating mechanism is made possible by the design and assembly of the mechanism configured within the baseplate.

The top encasement can be closed onto the base plate in a manner such that it can be selectively orientated; allowing the viewing screen to be seen or hidden if applicable. When the encasement is not closed, it can be selectively oriented with the top encasement extended outwardly to any degree up to 270 degrees and turned and rotated any degree up to and including 360 degrees for viewing the viewing screen of the compact portable device if applicable.

The top encasement, which holds the compact portable device, is attachable and detachable to the base plate via the tongue extension of the base plate for example, which attaches to the back of the encasement. This tongue extension can be extended at least 2 to 3 times the length of the device holder itself. The tongue extension is to include but not limited to; being a part of the actual chassis of the compact portable device, a part of the top encasement that surrounds the compact portable device, or part of the base plate of the unit itself by which the top encasement can be attached. The tongue can be extended out do any desired length until the top encasement can actually be taken off.

The clenching clip allows the user to attach the unit to a number of items with varying thicknesses securely. The clenching clip allows the user to control the amount of closure needed for clipping the unit to an article such as a strap or belt for example. Often, straps are vertical and the ability to keep the unit from sliding down requires a firm steady attachment. This clenching clip gives the tight secure hold that is needed. The unit can be attached without using the "notches" if desired. The first "notch" allows for a thicker item, the second—a little thinner, the third—even thinner and so on.

In one aspect the user can attach the unit to a purse for example, and keep the top encasement closed facing out or closed facing in. In another aspect, the user can attach the unit to a belt for example, tilt the top encasement out any degree decided between zero and 270, tilt the top encasement in either direction any number of angles, pull the top encasement out to any desired length on the tongue, and in addition, rotate the top encasement from zero to 360 degrees and either direction they decide in order to view the compact portable device, which is secured inside of the top encasement. The user therefore, is given the freedom to lie down, stand, walk, hike, bike, etc. and still have immediate, hands free access to the compact portable device with it's extra long extension (if desired) without having to remove it from the unit. It allows the user to extend the device and at the same time have numerous varying degrees of tilt and rotate of said apparatus simultaneously.

The unit also permits a user to selectively detach the compact portable device from the unit and to selectively place the unit, with the compact portable device thus detached, in a disposition in which the top encasement and the base plate are disposed in generally facing relationship to one another, or in a disposition in which the top encasement and the base plate are not disposed in generally facing relationship to one another—i.e., the top encasement may be swiveled relative to the base plate. If the top encasement and the base plate are not disposed in generally facing relationship to one another—i.e., if the top encasement is swiveled at an angle to the base plate, the user can conveniently re-attach the compact portable device to the top encasement and then be able to immediately view the viewing screen on the thus re-attached compact portable device.

While specific embodiments of the invention have been illustrated and described herein, it is realized that numerous modifications and changes will occur to those skilled in the art. It is therefore to be understood that the intricacies within the general descriptions are to be covered under modifications and changes as fall within the true spirit and scope of the invention.

What is claimed is:

1. A device for securing a compact portable device to an article, comprising:

a base plate attachable to the article;

a detachable encasement panel associated with the base plate;

a tilt and rotate element attached to the base plate and having a tongue extension which is attached to a detachable encasement panel so as to permit the encasement panel to tilt and to permit zero to 360 degree rotation simultaneously during varying degrees of tilt with relation to the base plate;

the tongue extension from the base plate permitting an attachment and detachment of the detachable encasement panel and where the tongue extension element is extendable;

a fastening arrangement attached to the base plate to permit attachment of the device to an article associated with a user; and where the device provides the user with the ability to tilt and rotate the detachable encasement panel and hold the detachable encasement panel in any desired position to permit hands free access to a compact portable device inserted into said detachable encasement panel.

2. The device of claim 1, where the fastening arrangement further comprises a connection element connected to the base plate and permitting a secure attachment of the device to an article of clothing, purse, bag, backpack, or other item associated with a user.

3. The device of claim 2, where the connection element comprises a clip having an adjustable clench capability for a secure attachment to an article or other item associated with the user.

4. The device of claim 1, where the tilt and rotate element permits a tilt angle between the base plate and the detachable encasement panel from 0 degrees to 270 degrees.

5. The device of claim 1, where the tilt and rotate element permits a 360 degree rotation of the detachable encasement panel with relation to the base plate.

6. The device of claim 1, where the tongue extension of the base plate is fully insertable into the detachable encasement panel and the detachable encasement panel is fully detachable from the tongue extension of the base plate.

7. The device of claim 1, where the tilt and rotate element permits a user to orient a compact portable device inserted within the detachable encasement panel in a facing or non-facing relationship with the base plate.

8. The device of claim 3, where the adjustable clench capability permits a user to selectively vary the retaining force with which the base plate is attached to an article of clothing, purse, bag, backpack, or other article associated with a user.

* * * * *